US006170840B1

(12) United States Patent
Mathias

(10) Patent No.: US 6,170,840 B1
(45) Date of Patent: Jan. 9, 2001

(54) SAFETY STAND

(76) Inventor: Jeri Mathias, 88 Auburn Ave., Sierra Madre, CA (US) 91024

( * ) Notice: Under 35 U.S.C. 154(b), the term of this patent shall be extended for 0 days.

(21) Appl. No.: 09/262,197

(22) Filed: Mar. 4, 1999

(51) Int. Cl.[7] ..... B62M 1/00; A61H 3/04

(52) U.S. Cl. ..... 280/87.041; 280/87.051; 280/87.05; 482/68; 135/69

(58) Field of Search ..... 280/87.021, 87.05, 280/87.01, 87.041, 87.051; 482/68; 135/67, 69

(56) References Cited

U.S. PATENT DOCUMENTS

| | | | | |
|---|---|---|---|---|
| 116,073 | * | 6/1871 | Maschmann | 280/87.051 |
| 631,889 | * | 8/1899 | Friedersdorff | 280/87.05 |
| 1,223,707 | * | 4/1917 | Lyon | 280/87.051 X |
| 2,538,324 | * | 1/1951 | Petrie | 280/87.051 |
| 4,953,851 | * | 9/1990 | Sherlock et al. | 280/87.051 |
| 4,964,430 | * | 10/1990 | Janis | 135/67 |
| 5,174,590 | * | 12/1992 | Kerley et al. | 280/87.051 X |
| 5,224,717 | * | 7/1993 | Lowen | 135/67 X |
| 5,366,231 | * | 11/1994 | Hung | 280/87.051 |
| 5,692,762 | * | 12/1997 | Obitts | 280/87.05 |
| 5,794,639 | * | 8/1998 | Einbinder | 135/67 |
| 5,819,772 | * | 10/1998 | Pi | 135/67 X |
| 6,003,532 | * | 12/1999 | Pi | 135/67 |

* cited by examiner

*Primary Examiner*—Daniel G. DePumpo
*Assistant Examiner*—F. Zeender

(57) ABSTRACT

A safety stand for helping keep a user stable and upright while in-line skating. The safety stand includes an upper ring defining a center space. A plurality of support legs downwardly extend from the upper ring to support the upper ring above a ground surface. The lower end of each of the support legs has a ground engaging swivel wheel.

17 Claims, 5 Drawing Sheets

SAFETY STAND

BACKGROUND OF THE INVENTION

1. Field of the Invention

The present invention relates to in-line skating safety accessories and more particularly pertains to a new safety stand for PURPOSE.

2. Description of the Prior Art

The use of in-line skating safety accessories is known in the prior art. More specifically, in-line skating safety accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,953,851 by Sherlock et al.; U.S. Pat. No. 5,083,806 by Brown; U.S. Pat. No. 4,941,497 Prather et al.; PCT Patent No. WO 96/29041 by Doyle et al; PCT Patent No. WO 95/31954 by Lorman; U.S. Pat. No. 3,180,678 by McCabe; and U.S. Pat. No. 1,826,502 by Brown.

While these devices fulfill their respective, particular objectives and requirements, the aforementioned patents do not disclose a new safety stand. The inventive device includes an upper ring defining a center space. A plurality of support legs downwardly extend from the upper ring to support the upper ring above a ground surface. The lower end of each of the support legs has a ground engaging swivel wheel.

In these respects, the safety stand according to the present invention substantially departs from the conventional concepts and designs of the prior art, and in so doing provides an apparatus primarily developed for the purpose of helping keep a user stable and upright while in-line skating.

SUMMARY OF THE INVENTION

In view of the foregoing disadvantages inherent in the known types of in-line skating safety accessories now present in the prior art, the present invention provides a new safety stand construction wherein the same can be utilized for helping keep a user stable and upright while in-line skating.

The general purpose of the present invention, which will be described subsequently in greater detail, is to provide a new safety stand apparatus and method which has many of the advantages of the in-line skating safety accessories mentioned heretofore and many novel features that result in a new safety stand which is not anticipated, rendered obvious, suggested, or even implied by any of the prior art in-line skating safety accessories, either alone or in any combination thereof.

To attain this, the present invention generally comprises an upper ring defining a center space. A plurality of support legs downwardly extend from the upper ring to support the upper ring above a ground surface. The lower end of each of the support legs has a ground engaging swivel wheel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new safety stand apparatus and method which has many of the advantages of the in-line skating safety accessories mentioned heretofore and many novel features that result in a new safety stand which is not anticipated, rendered obvious, suggested, or even implied by any of the prior art in-line skating safety accessories, either alone or in any combination thereof.

It is another object of the present invention to provide a new safety stand which may be easily and efficiently manufactured and marketed.

It is a further object of the present invention to provide a new safety stand which is of a durable and reliable construction.

An even further object of the present invention is to provide a new safety stand which is susceptible of a low cost of manufacture with regard to both materials and labor, and which accordingly is then susceptible of low prices of sale to the consuming public, thereby making such safety stand economically available to the buying public.

Still yet another object of the present invention is to provide a new safety stand which provides in the apparatuses and methods of the prior art some of the advantages thereof, while simultaneously overcoming some of the disadvantages normally associated therewith.

Still another object of the present invention is to provide a new safety stand for helping keep a user stable and upright while in-line skating.

Yet another object of the present invention is to provide a new safety stand which includes an upper ring defining a center space. A plurality of support legs downwardly extend from the upper ring to support the upper ring above a ground surface. The lower end of each of the support legs has a ground engaging swivel wheel.

Still yet another object of the present invention is to provide a new safety stand that may be quickly and easily modified to support a ice skater upright on an ice surface.

Even still another object of the present invention is to provide a new safety stand that adjustable to suit a large range of user heights.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
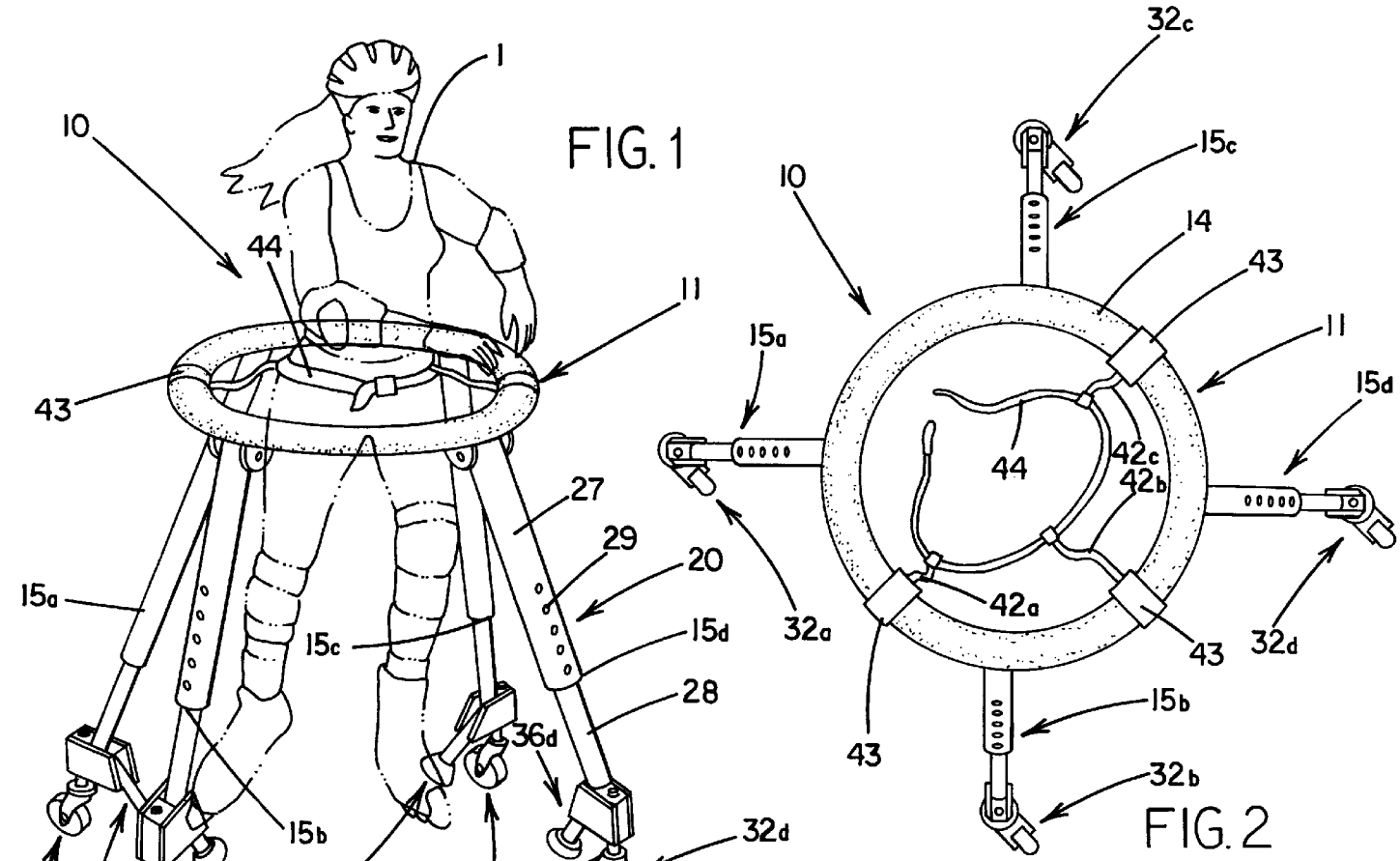
FIG. 1 is a schematic perspective view of a new safety stand in use with an in-line skate user according to the present invention.
FIG. 2 is a schematic top plan view of the present invention.

With reference now to the drawings, and in particular to FIGS. 1 through 9 thereof, a new safety stand embodying the principles and concepts of the present invention and generally designated by the reference numeral 10 will be described.

As best illustrated in FIGS. 1 through 9, the safety stand 10 generally comprises an upper ring defining a center space. A plurality of support legs downwardly extend from the upper ring to support the upper ring above a ground surface. The lower end of each of the support legs has a ground engaging swivel wheel.

In closer detail, the safety stand 10 for a skater skating on a surface comprises a continuous generally circular upper ring 11 defining a center space. The upper ring has a circumference and a diameter. Preferably, the upper ring is generally tubular for reducing the weight of the upper ring and has a generally circular transverse cross section. As illustrated in FIG. 1, the upper ring is designed for extending around the body of an in-line skate user 1. The upper ring also preferably comprises a rigid material such as a metal or rigid plastic. Preferably, the diameter of the upper ring is greater than 2 feet and less than about 6 feet. In an ideal illustrative embodiment, the diameter of the upper ring is about 3 feet.

Figure 5:
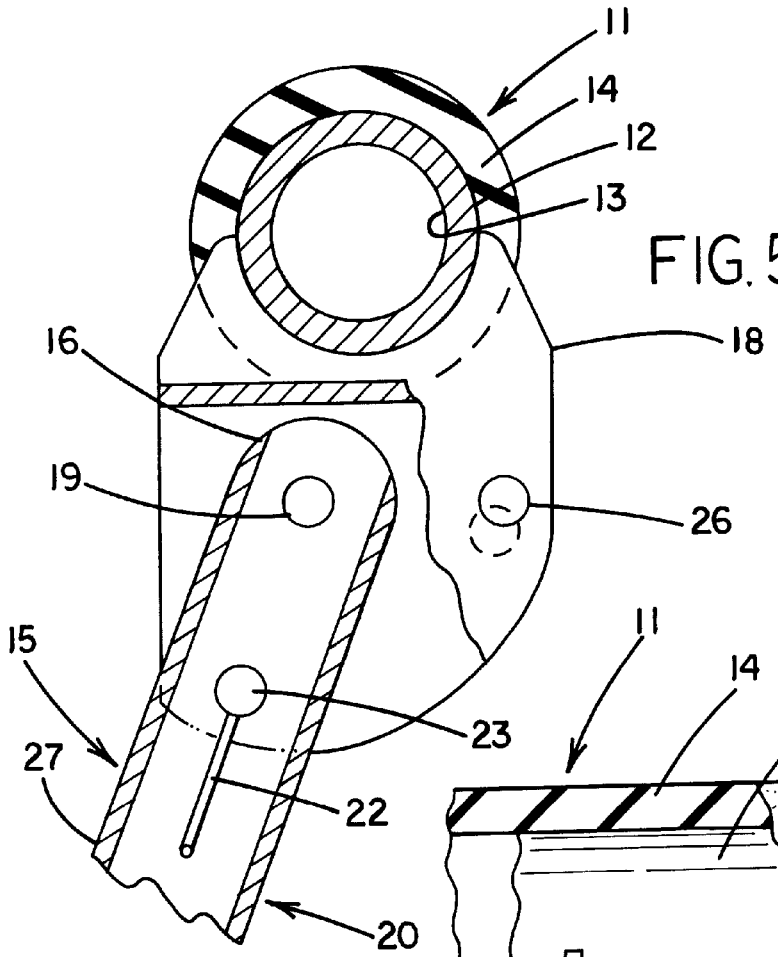
FIG. 5 is a schematic cross sectional view of the upper end at a coupling thereto of a support leg.
Figure 6:
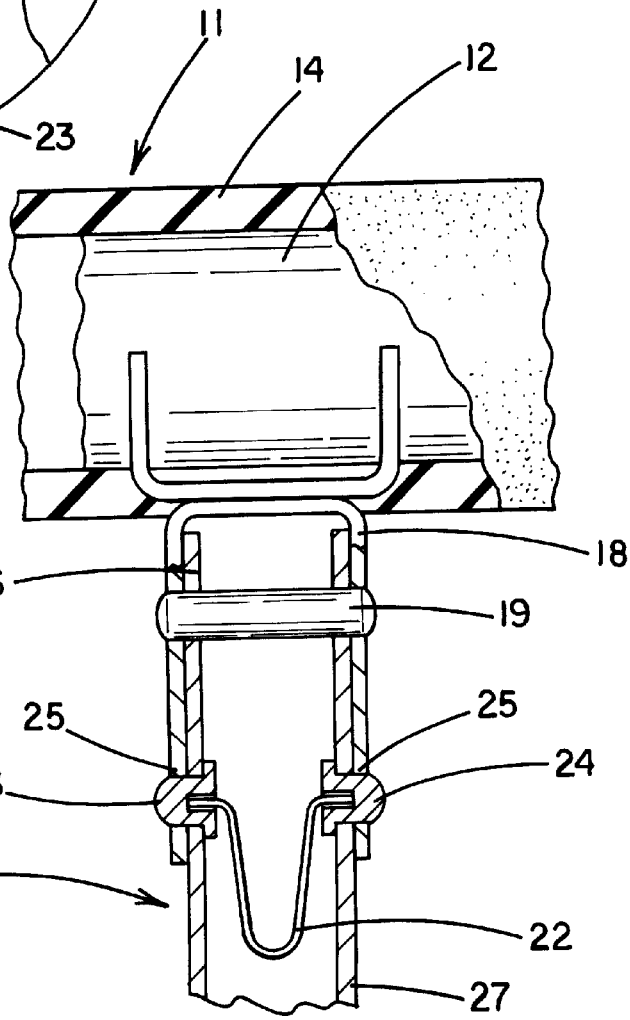
FIG. 6 is another schematic cross sectional view of the upper end at a coupling thereto of a support leg.

As best illustrated in FIGS. 5 and 6, the upper ring has an exterior 12 and the a lumen 13 with the thickness of the upper ring defined between the exterior and lumen of the upper ring. In a preferred embodiment, the upper ring has a resiliently compressible outer padded layer 14 substantially covering the exterior of the upper ring. Ideally, the outer padded layer comprises a resiliently compressible foamed material such as a foamed rubber. Preferably, the outer layer has a thickness greater than the thickness of the upper ring. Ideally, the thickness of the outer ring is at least about twice the thickness of the upper ring for providing an optimal amount of comfort to a user grasping the upper ring.

A plurality of support legs 15*a*,15*b*,15*c*,15*d* downwardly and radially outwardly extend from the upper ring. In use, the support legs are designed for supporting the upper ring above a ground surface as best shown in FIG. 1. Each of the support legs 15 has opposite upper and lower ends 16,17, and a longitudinal axis extending between the upper and lower ends.

Figure 3:
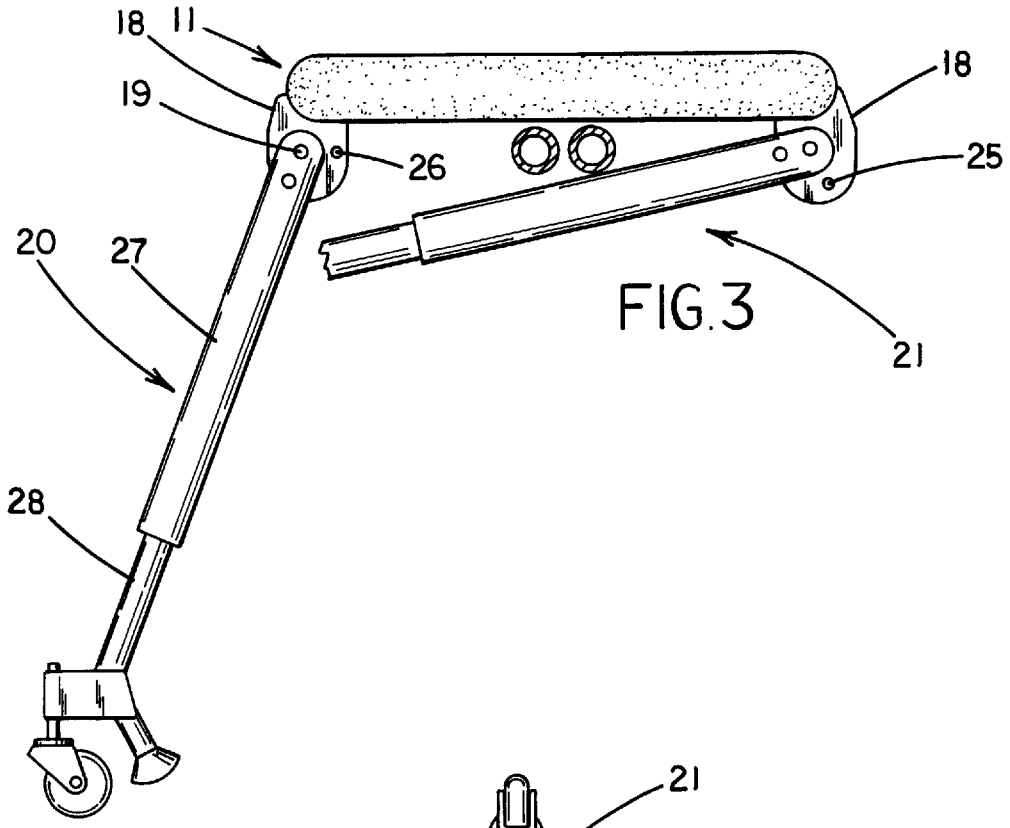
FIG. 3 is a schematic side view of the present invention illustrating the deployed and folded positions of the support legs.
Figure 4:
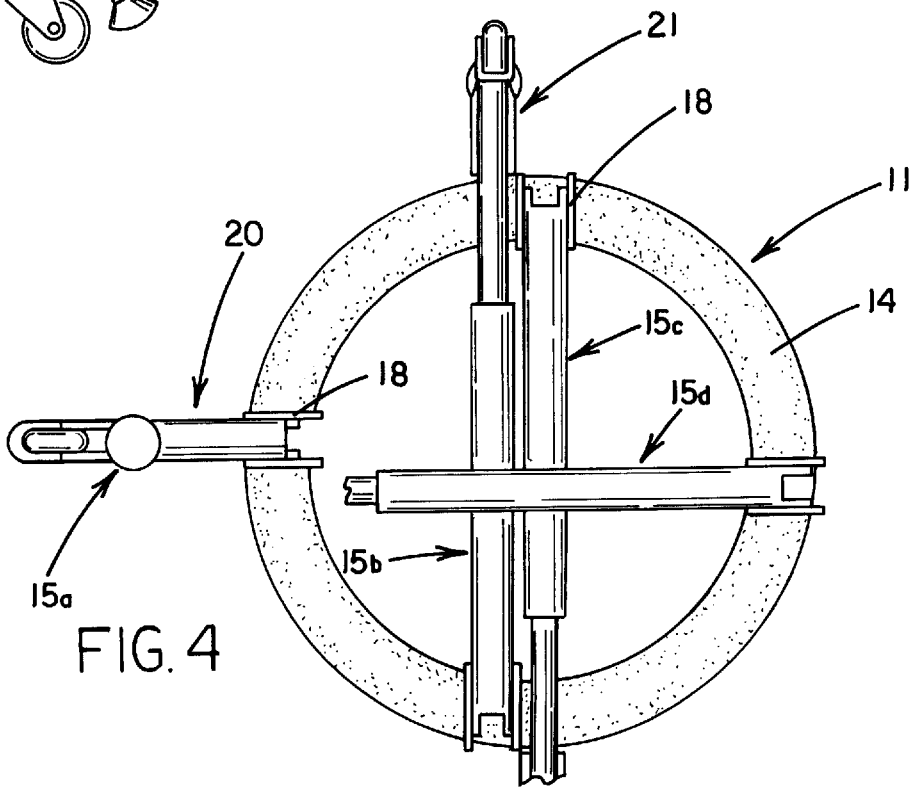
FIG. 4 is a schematic bottom view of FIG. 3 to further illustrate the deployed and folded positions of the support legs.

The upper ends of the support legs are coupled to the upper ring. Preferably, the upper ends of the support legs are pivotally coupled to the upper ring. With reference to FIGS. 5 and 6, in this preferred embodiment, the upper end of each support leg ideally has a pivot bracket 18 and pivot pin 19 pivotally coupling the upper end of the respective support leg to the upper ring. As illustrated in FIGS. 3 and 4, in use, each of the support legs is pivotable between a deployed position 20 and a folded position 21.

Each of the support legs has a holding means for releasably holding the respective support leg in either the deployed or folded positions. Preferably, each of the holding means comprises a pair of spring 22 biased holding pins 23,24 that outwardly extend from the upper end of the respective support leg into a corresponding hole of a pair of holes 25,26 in each side of the pivot bracket. One hole 25 of each side of each pivot bracket is positioned to position the respective support leg in the deployed position when the associated holding pin is extended therein. The other hole 26 of each side of each pivot bracket is positioned to position the respective support leg in the folded position when the associated holding pin is extended therein.

Preferably, the upper ends of the support legs are spaced apart at generally equal intervals around the circumference of the upper ring. The plurality of support legs comprises at least three support legs and ideally comprises four support legs (as illustrated in the Figures) such that an arc of about 90 degrees is formed along the circumference of the upper ring between the upper ends of adjacent support legs. The longitudinal axis of each support leg is extended at an acute angle with respect to the plane in which the upper ring lies when the support leg is positioned in the respective deployed position. The acute angles of each of the support legs are preferably generally equal to one another. Preferably, the acute angle of each of the support legs is between about 1 degree and about 89 degrees. Ideally, the acute angle of each of the support legs is between about 45 degrees and about 80 degrees.

Figure 9:
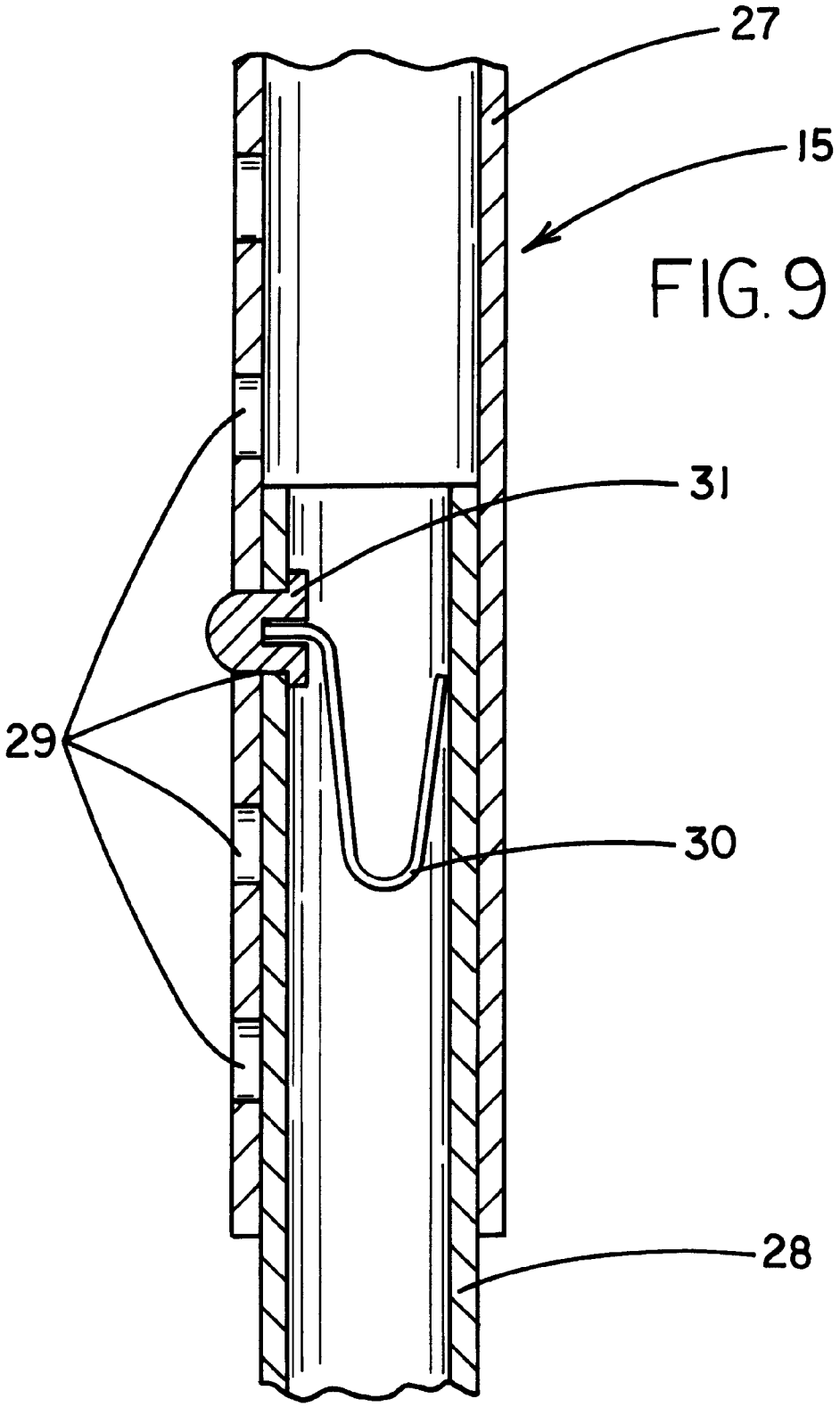
FIG. 9 is a schematic cross sectional view of the union between upper and lower telescopic portions of a support leg.

Preferably, each of the support legs is telescopically extendible in a direction along the longitudinal axis the respective support leg. In this telescopic embodiment, each of the support legs preferably has upper and lower telescopic portions 27,28 with each of the lower telescopic portions 28 telescopically inserted into the associated upper telescopic portion 27. The upper telescopic portion of each of the support legs has a row of holes 29 located adjacent the associated lower telescopic portion, the row of holes extending generally parallel to the longitudinal axis of the respective support leg. With particular reference to FIG. 9, the lower telescopic portion of each of the support legs has a spring 30 biased set pin 31 therein. In use, the set pin is insertable into one of the holes of the row of holes of the associated upper telescopic portion to hold the lower telescopic portion in a fixed position with respect to the associated upper telescopic portion.

Each of the support legs has a length defined between the upper and lower ends of the respective support leg. Preferably, the lengths of each of the support legs fully extended is at least about 1 foot greater than the diameter of the upper ring. Also preferably, the length of each of the support legs is extendable between about 2 feet and about 6 feet. Ideally, the length of each of the support legs is extendable between about 2 feet and about 4 feet.

Figure 7:
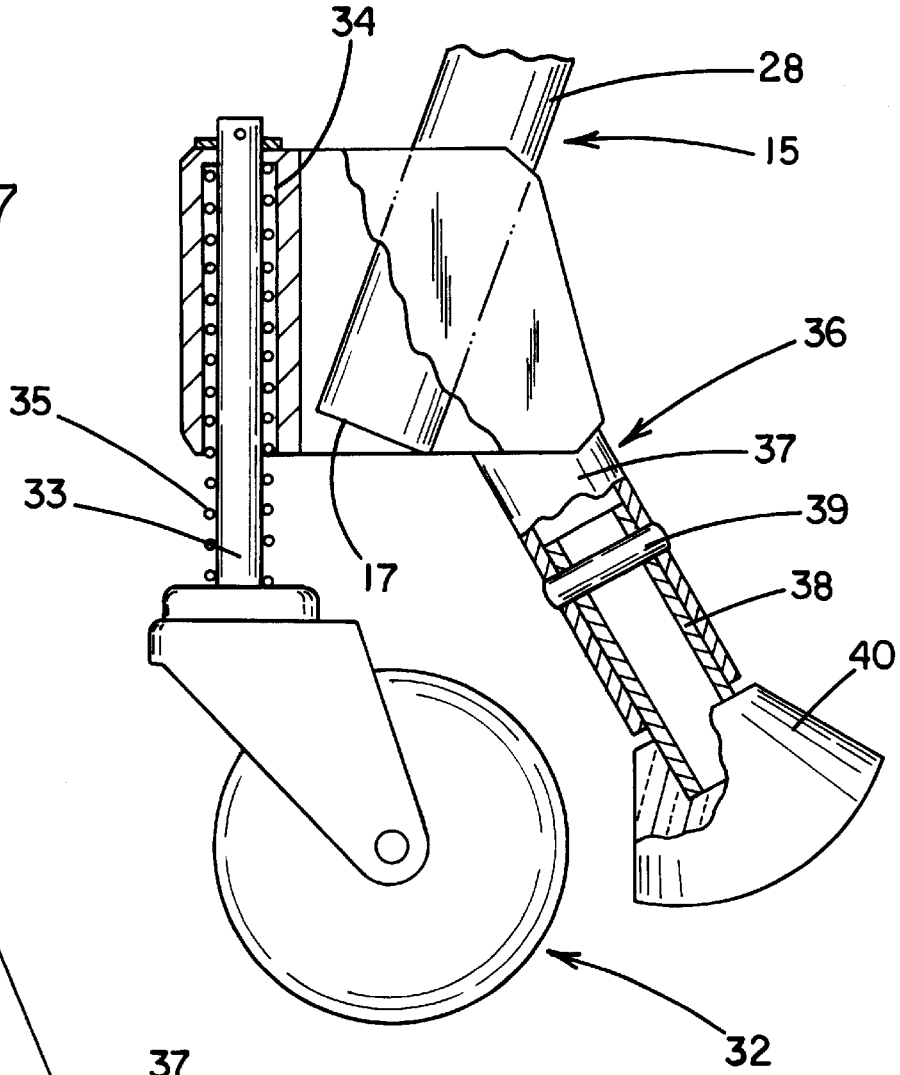
FIG. 7 is a schematic partial cross sectional view of a swivel wheel and braking foot embodiment of the brake assembly.

The lower end of each of the support legs has a ground engaging swivel wheel 32*a*,32*b*,32*c*,32*d* coupled thereto. Optionally, at least one of the ground engaging swivel wheels may be a locking caster to releasably hold the particular wheel against rotation. As best illustrated in FIG. 7, each swivel wheel 32 is preferably mounted to the lower end of the associated support leg by an upwardly extending swivel shaft 33 extending through a swivel bore 34 in the lower end of the associated support leg. Each swivel shaft has a coiled spring 35 disposed therearound which biases the lower end of each support leg away from the associated swivel wheel. In use, downwards pressure on the support leg (such as by a user pressing downwards on the upper ring) compresses the coiled springs to permit the lower end of the respective support let to slide down the swivel shaft so that the lower end of the support leg is closer to the adjacent associated swivel wheel.

Figure 8:
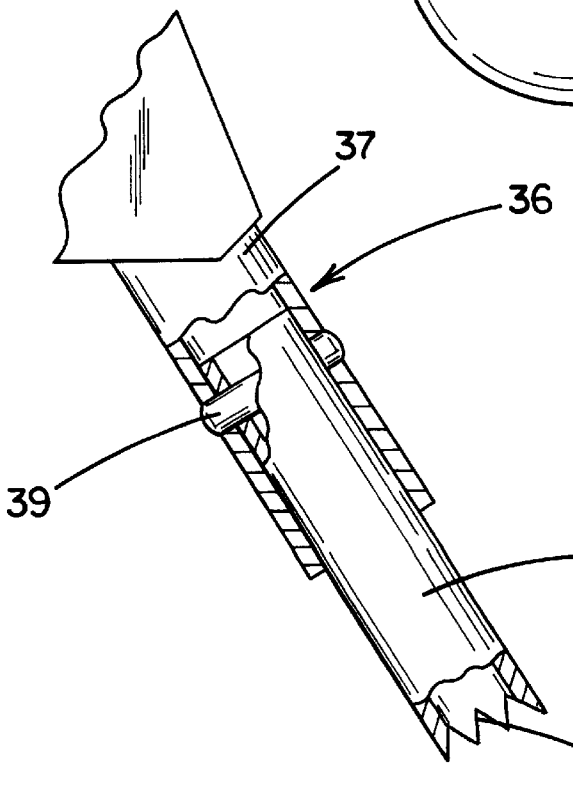
FIG. 8 is a schematic partial cross sectional view of the braking teeth embodiment of the brake assembly.

The lower end of each support leg has preferably a brake assembly 36*a*,36*b*,36*c*,36*d* for selectively frictionally engaging a ground surface to help slow and stop movement of the safety stand and therefore the user across the ground surface. As best shown in FIGS. 7 and 8, the brake assemblies 36 each comprise a brake tube 37 downwardly extending from the lower end of the respective support leg, and a tubular rod 38 removably inserted into the brake tube such that the tubular rod downwardly extends from the brake tube. Preferably, a release pin 39 releasably holds each tubular rod to the associated brake tube. With reference to FIG. 7, for a safety stand used for in-line skating and roller skating, the tubular rods each terminate at a resiliently deformable braking foot 40 designed for frictionally engaging hardwood (such as floors) or concrete surfaces (such as road and sidewalk surfaces). In this embodiment, the braking feet slow movement of the safety stand and user across the ground surface when the coiled springs are compressed to move the lower ends of the support legs far enough down (and closer to the associated swivel wheels) so that the braking feet come into contact with the ground surface. FIG. 8 illustrates an embodiment of the brake assembly for use for ice skating users where the tubular rods each terminate at a plurality of braking teeth 41 designed for frictionally engaging an ice surface. When the coiled springs are compressed to move the lower ends of the support legs far enough down (and closer to the associated swivel wheels), the braking teeth come into contact with the ice surface to thereby slow movement of the safety stand and user across the ground surface.

Preferably, a plurality of elongate flexible straps 42*a*,42*b*, 42*c* are also provided. Ideally, the plurality of straps comprises three straps. Each strap has a pair of opposite ends. One end of the each of the straps is coupled to the upper ring preferably by an attachment band 43 disposed around the upper ring. The other ends of the straps are attached to a belt 44 designed for securing around the waist of a user as illustrated in FIG. 1 to secure the upper ring to the user. Each of the flexible straps has a length defined between the ends of the respective strap. Preferably, the length of each strap is about equal to the diameter of the upper ring.

In use, an in-line skate user first stands in the center space. The lengths of the support legs such be adjusted so that the plane of the upper ring is generally horizontal and positioned at about the height of the user's waist. The belt is then secured around the waist of the user. When the user is skating, the user may grasp the upper ring for extra stability. If the user starts to fall or lose their balance the user should shift support of their weight with their hands on to the upper ring to help stabilize the user and help the user remain upright. The user may also shift their weight when grasping the upper ring to press down on the upper ring to compress the coiled springs 35 to position the brake assemblies closer to the surface being traversed by the user and the safety stand so that the braking foot or the braking teeth may engage the traversed surface to slow or stop the movement of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A safety stand, comprising:

an upper ring defining a center space;

a plurality of support legs downwardly extending from said upper ring, said support legs being adapted for supporting said upper ring above a ground surface, each of said support legs having opposite upper and lower ends, and a longitudinal axis extending between said upper and lower ends;

said lower end of each of said support legs having a ground engaging swivel wheel;

a belt adapted for securing about a waist of the user positioned in the center space;

a plurality of elongate flexible straps each having a pair of opposite ends, one end of said each of said straps being coupled to said upper ring, another of said ends of each of said straps being secured to said belt at spaced locations on said belt to secure said upper ring to the user;

wherein each of said support legs is telescopically extendible in a direction along the longitudinal axis of said respective support leg;

wherein each of said support legs has upper and lower telescopic portions, each of said lower telescopic portions being telescopically inserted into the associated upper telescopic portion;

wherein said lower end of each support leg has a brake assembly for selectively frictionally engaging a ground surface when a user places downward force on said upper ring; and wherein said brake assemblies each comprise a brake tube downwardly and inwardly extending from said lower end of the respective support leg.

2. The safety stand of claim 1, wherein said upper ring is generally tubular and has a generally circular transverse cross section, and wherein said upper ring has a resiliently compressible outer padded layer substantially covering said upper ring.

3. The safety stand of claim 2, wherein said outer padded layer comprises a resiliently compressible foamed material.

4. The safety stand of claim 2, wherein said outer layer has a thickness greater than said upper ring.

5. The safety stand of claim 4, wherein said thickness of said outer layer is at least about twice the thickness of said upper ring.

6. The safety stand of claim 1, wherein said upper ends of said support legs are pivotally coupled to said upper ring.

7. The safety stand of claim 6, wherein said upper ring lies in a plane, wherein each of said support legs is pivotable between a deployed position and a folded position, wherein said longitudinal axis of each support leg is extended at an acute angle with respect to said plane of said upper ring when said support legs are positioned in the respective deployed position and wherein said longitudinal axis of each support leg is extended substantially parallel to said plane of said upper ring when said support legs are positioned in the respective folded position for compact storage.

8. The safety stand of claim 7, wherein each of said support legs are selectively lockable in said deployed position and said folded position.

9. The safety stand of claim 7, wherein said acute angle of each of said support legs is between about 45 degrees and about 80 degrees.

10. The safety stand of claim 1, wherein said tipper ends of said support legs are spaced apart at generally equal intervals around said circumference of said upper ring.

11. The safety stand of claim 1, wherein said plurality of support legs comprises at least three support legs.

12. The safety stand of claim 1, wherein said plurality of support legs comprises four support legs.

13. The safety stand of claim 1, wherein at least one of said ground engaging swivel wheels comprises a locking caster.

14. The safety stand of claim 1, wherein said brake assemblies each comprise a tubular rod inserted into the brake tube such that said tubular rod downwardly extends from said brake tube.

15. The safety stand of claim 1, wherein said tubular rods each terminate in a resiliently deformable braking foot.

16. The safety stand of claim 1, wherein said tubular rods each terminate in a plurality of braking teeth adapted for frictionally engaging an ice surface.

17. A safety stand, comprising:

a continuous generally circular upper ring defining a center space, said upper ring having a circumference and a diameter;

said upper ring being generally tubular and having a generally circular transverse cross section, said upper ring being adapted for extending around the body of a user;

said upper ring having a thickness;

said upper ring having a resiliently compressible outer padded layer substantially covering said upper ring, wherein said outer padded layer comprises a resiliently compressible foamed material;

wherein said outer layer has a thickness greater than twice said thickness of said upper ring;

a plurality of support legs downwardly and outwardly extending from said upper ring, said support legs being adapted for supporting said upper ring above a ground surface, each of said support legs having opposite upper and lower ends, and a longitudinal axis extending between said upper and lower ends;

said upper ends of said support legs being coupled to said upper ring, wherein said upper ends of said support legs are pivotally coupled to said upper ring;

each of said support legs being pivotable between a deployed position and a folded position;

said upper ends of said support legs being spaced apart at generally equal intervals around said circumference of said upper ring;

said upper ring lying in a plane, said longitudinal axis of each support leg being extended at an acute angle with respect to said plane of said upper ring when the support leg is positioned in the respective deployed position, wherein said acute angle of each of said support legs is between about 45 degrees and about 80 degrees;

each of said support legs being telescopically extendible in a direction along the longitudinal axis the respective support leg, each of said support legs having upper and lower telescopic portions, each of said lower telescopic portions being telescopically inserted into the associated upper telescopic portion;

said upper telescopic portion of each of said support legs having a row of holes located adjacent the associated lower telescopic portion, said row of holes extending generally parallel to the longitudinal axis of the respective support leg;

said lower telescopic portion of each of said support legs having a spring biased set pin therein, said set pin being insertable into a hole of the associated upper telescopic portion to hold said lower telescopic portion in a fixed position with respect to the associated upper telescopic portion;

said lower end of each of said support legs having a ground engaging swivel wheel;

said lower end of each support leg having a brake assembly for selectively frictionally engaging a ground surface;

wherein said brake assemblies each comprise a brake tube downwardly extending from said lower end of the respective support leg, and a tubular rod being inserted into the brake tube such that said tubular rod downwardly extends from said brake tube;

wherein said tubular rods each terminates in a resiliently deformable braking foot;

a plurality of elongate flexible straps each having a pair of opposite ends, each of said flexible straps having a length defined between said ends of the respective strap, wherein said length of each strap is about equal to said diameter of said upper ring;

one end of said each of said straps being coupled to said upper ring; and another of said ends of each of said straps being adapted for securing to the body of the user positioned in the center space to secure the upper ring to the user.

* * * * *